United States Patent [19]

Stewart

[11] 4,274,246

[45] Jun. 23, 1981

[54] UNIVERSAL BIT APPARATUS

[76] Inventor: William M. Stewart, 6620 NW. 61st St., Ocala, Fla. 32670

[21] Appl. No.: 130,740

[22] Filed: Mar. 17, 1980

[51] Int. Cl.[3] ..... B68B 1/04; B68B 1/06

[52] U.S. Cl. ..... 54/6 R; 54/7

[58] Field of Search ..... 54/7, 8, 6 R

[56] References Cited

U.S. PATENT DOCUMENTS

| | | | |
|---|---|---|---|
| 2,193,451 | 3/1940 | Fryer | 54/7 |
| 2,225,232 | 12/1940 | Ray | 54/7 X |
| 2,349,375 | 3/1944 | Ray | 54/6 R |

*Primary Examiner*—Hugh R. Chamblee

[57] ABSTRACT

An interchangeable mouthpiece bit for use with horses or the like includes a pair of spaced apart shank members adapted at one end thereof for connection to a structure for attachment to a horse's head and adapted at the other end thereof for connection to reins. A mouthpiece is attached to an intermediate portion of each of the shank members for insertion into the mouth of a horse. A connection for selectively detaching and re-attaching the mouthpiece to the shank members is provided so that one pair of shank members can be used with a plurality of different mouthpieces. The mouthpiece connection includes a post attached at one end thereof to an intermediate portion of each of the shank members. A post receiving member is connected to the ends of the mouthpiece for being slideable onto the post and extending around the post far enough to allow only slideable movement between the post and the post receiving member when the post receiving member is disposed on the post. A locking structure is attached to an intermediate portion of the shank members for selectively preventing slideable movement between the post and the post receiving member.

9 Claims, 4 Drawing Figures

UNIVERSAL BIT APPARATUS

BACKGROUND OF THE INVENTION

The present invention relates generally to bits for horses or the like and more particularly to a bit structure having an interchangeable mouthpiece.

It is well known that there are many different kinds of bits for use in riding horses, mules, donkeys, burrows, etc. While certain mouthpiece configurations for certain bits tend to be somewhat more universal than others, still there is a need to be able to fit the bit and mouthpiece to the particular animal for which it is to be used. Furthermore, during the training process certain bits may be used on a particular animal which may not be necessary once the animal is adequately trained. Consequently, it has been considered to be necessary to have a large number of bits available when many different animals are to be ridden and this array of necessary bits is only magnified if the animals are going through a training process.

When animals are being shown, such as at horse shows, more formal and fancy equipment is normally used in order to present the animal at its best. Consequently, it has become customary to use bits with ornate inlays, normally made of silver. These bits are naturally more expensive than the ordinary steel bits because of the precious metals needed and the workmanship involved. Because of the high expense of these fancy bits, the problem identified above is magnified.

Consequently, there is a need for bit structures which will reduce the cost of having the proper bit required and reduce the number of bits needed by having a bit structure which is more universal and adaptable than what is available in the prior art.

SUMMARY OF THE INVENTION

The present invention relates to an interchangeable mouthpiece bit for use with horses or the like and includes a pair of spaced apart shank members adapted at one end thereof for connection to a structure for attachment to a horse's head and adapted at the other end thereof for connection to reins. A mouthpiece is attached to an intermediate portion of each of the shank members for insertion into the mouth of a horse. A connection for selectively detaching and re-attaching the mouthpiece to the shank members is provided so that one pair of shank members can be used with a plurality of different mouthpieces. The mouthpiece connection includes a post attached at one end thereof to an intermediate portion of each of the shank members.

A post receiving member is connected to the ends of the mouthpiece for being slideable onto the post and extending around the post far enough to allow only slideable movement between the post and the post receiving member when the post receiving member is disposed on the post. A locking structure is attached to an intermediate portion of the shank members for selectively preventing slideable movement between the post and the post receiving member.

An object of the present invention is to provide an improved bit for animals such as horses.

Another object of the invention is to provide a novel bit structure having interchangeable mouthpiece members for use with one pair of shank members.

A further object of the invention is to eliminate the need for separate bits for different animals or different occasions.

Still another object is to provide a universal bit structure which is economical to manufacture, fast and simple to change, and dependable to use.

Other objects, advantages, and novel feature of the present invention will become apparent from the following detailed description of the invention when considered in conjunction with the accompanying drawings.

DESCRIPTION OF THE PREFERRED EMBODIMENTS

Figure 1:
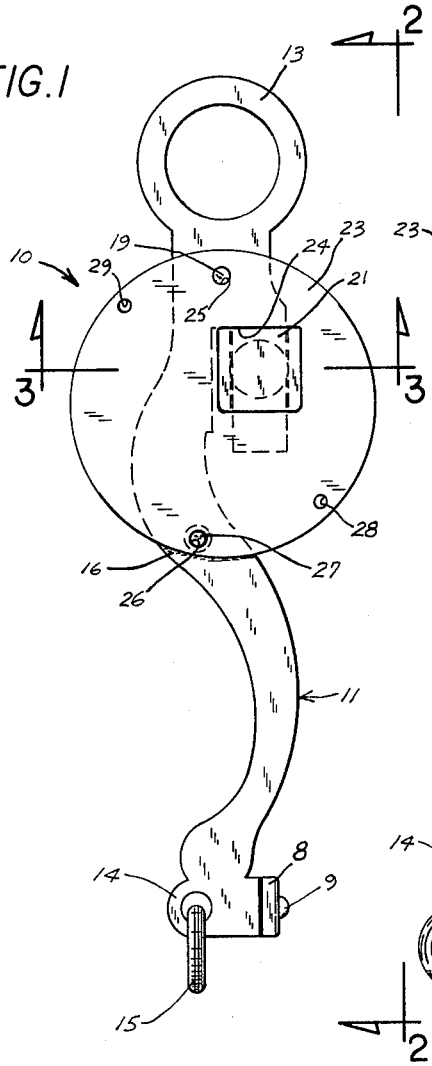
FIG. 1 is a side-elevational view of a bit constructed in accordance with the present invention, the opposite side being substantially the same as the side shown.

Referring now to the drawings wherein like reference numerals designate identical or corresponding parts throughout the several views, FIG. 1 shows a bit 10 constructed in accordance with the present invention. The bit 10 includes a pair of shank members 11 and a mouthpiece 12.

Referring now with more particularity to the shank members, it is noted that end 13 of the shank members 11 has a ring-like configuration for connection to straps, chains, or the like for the purpose of securing this portion of the shank members to a horse's head. The other end 14 of the shank members 11 has conventional structures such as a metal reinforcement and spacer member 8 held in place by fasteners 9. Rings 15 are provided for connection to reins.

Figure 4:
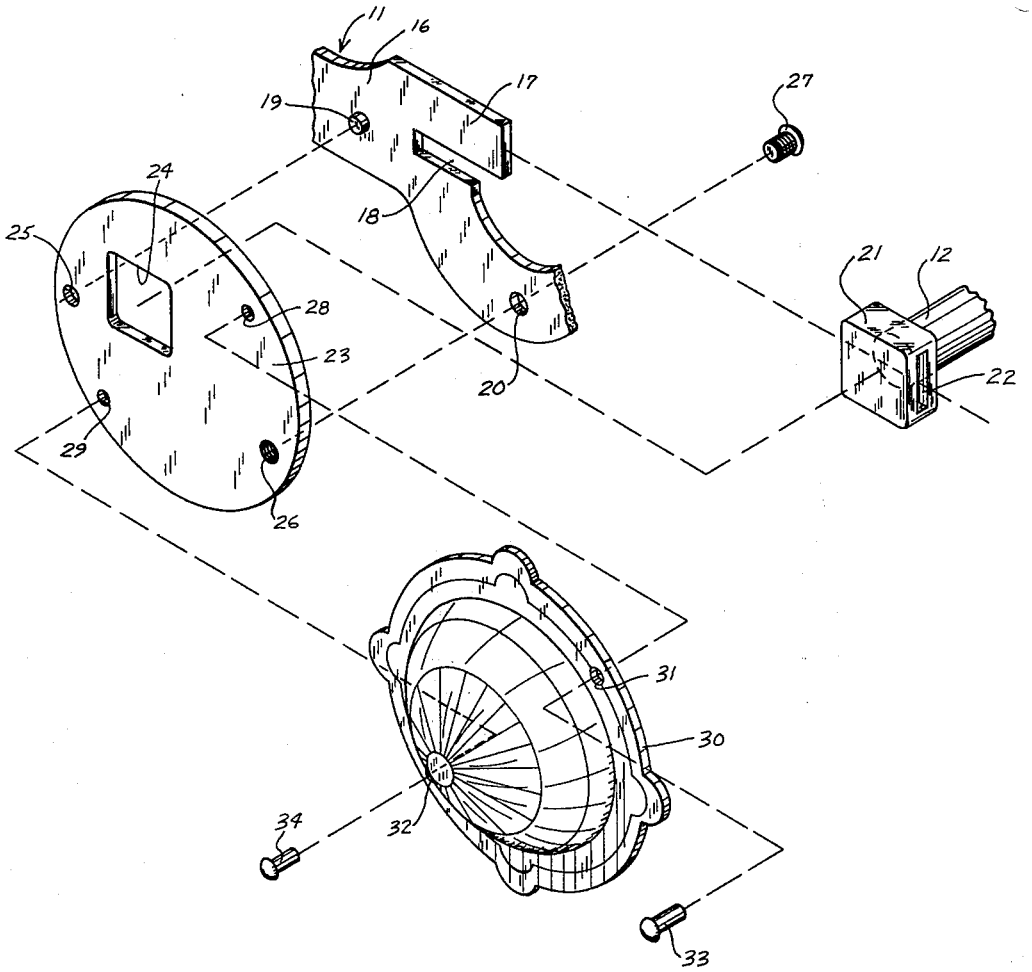
FIG. 4 is a partial exploded perspective view of the embodiment shown in FIGS. 1–3, but including an additional decorative outer concho plate attached thereto.

Referring now to FIG. 4, it is noted that an intermediate part 16 of the shank members 11 has a post member 17 attached thereto for reasons which will be explained below. A notch 18, formed in the intermediate section 17 of each shank member 11, is provided for extending the effective length of the post 17. A peg or protuberance 19 extends outwardly from one side of the intermediate portion 16, and a hole 20 is disposed completely through the intermediate portion 16 of the shank member 11.

The mouthpiece member 12 can be of many different configurations, and the particular configuration of the centermost portion of the mouthpiece member 12 is a matter of choice and does not form a part of this invention. On each end of the mouthpiece 12, a post receiving structure 21 is rigidly attached thereto. This post receiving structure 21 has a slot 22 extending therethrough, and this slot 22 is substantially the same shape and size as the post member 17 such that the post receiving means 21 can slide over the post 17 whereby the post 17 is disposed within the slot 11 of the post receiving means 21.

A locking plate 23 is provided for locking the post receiving means to the intermediate portion 16 of the shank member 11 as will be referred to below. This locking plate 23 has an opening 24 disposed therein which is substantially of the same shape and configuration as the end view outline of the post receiving means 21. A hole 25 is provided on one side of the locking plate 23 for reception of the peg 19 and a threaded hole 26 is provided on the other side of the locking plate for engagement with a bolt 27. Optional holes 38 and 29 are provided in FIG. 4 for reception of a decorative concho plate 30, with holes 31 and 32 therein for receiving rivets 33 and 34 therethrough. If this optional concho plate 30 is to be used as shown in dashed lines in FIG. 3 and solid lines in FIG. 4, then the openings 28 and 29 of the plate 23 would first be aligned with the openings 31 and 32, respectively, of the choncho plate 30. The rivets 33 and 34 would then be placed through the openings, rivet 33 being placed through the openings 28 and 31 and then secured in place; and, the rivet 34 being placed through the openings 29 and 32 and secured in place in a conventional fashion. It is to be understood that the present invention can be used with or without such decorative concho plate 30 and that other types of fastening devices other than rivets may be used without departing from the scope of this invention.

Figure 2:
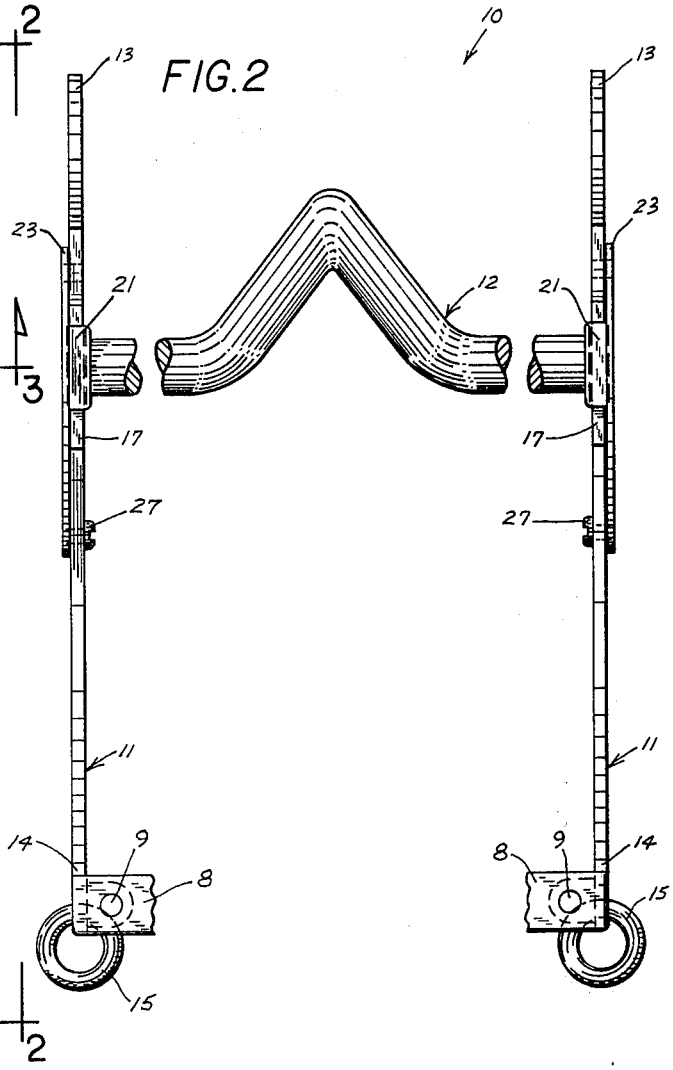
FIG. 2 is a top view taken along line 2—2 of FIG. 1.
Figure 3:
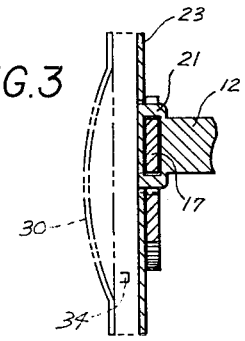
FIG. 3 is a partial cross-sectional view taken along line 3—3 of FIG. 1.

In operation, the bit would normally be assembled as shown in solid lines in FIGS. 1–3. If it is desired to use a different mouthpiece member 12, other mouthpiece members would be available having ends thereon substantially identical to the post receiving structure 21 and 22 on mouthpiece member 12. In order to change such mouthpiece members 12, the bolt 27 would be rotated in the proper direction in order to disengage it with the threads 26 on the locking plate 23. Once this was done, then the locking plate 23, with or without the concho plate 30 attached thereto, could be moved outwardly therefrom, whereby the hole 25 would slide out over the peg 19 and the opening 24 and locking plate 23 would be moved outwardly whereby the post receiving member 21 would not be disposed thereon. This identical operation would be performed on each side; that is, on each shank member 11. The mouthpiece means 12 could then be removed from the shank members 11 by sliding the post receiving members 21 off of the post 17 or visa versa.

To place a mouthpiece means similar to, but not identical with, the mouthpiece 12 shown, a reverse procedure would be performed. For example, the new mouthpiece, not shown but like the mouthpiece 12 at the ends thereof, having identical structures 21 attached to the ends thereof, would then be slid onto the post members 17 on each of the two spaced apart shank members 11. The locking plate 23 would then be moved such that the pegs 19 extend into the openings 25 and the member 21 extends into the opening 24. The bolt 27 would then be again inserted through the opening 20 and rotated so as to threadably engage the threads 26 on the locking plate 23 until the bolt 27 is secure and thereby the locking plate 23, with or without the concho plate 30 attached thereto, is secured to the intermediate portion 16 of the shank members 11. The opening 24 and the locking plate 23 prevent the post receiving means from sliding off of the post as long as the locking plate 23 is secured to the shank members 11.

The particular configuration of the post 17 is not important, except that it must be substantially complementary with respect to the shape of the opening 22. The particular configuration of the post receiving means 27 is not crucial, except that it must extend at least partially around the post 17 to prevent it from falling off of the post 17; and, this post receiving means 21 must also be constructed such that it is complementary with respect to the opening 24 in the locking plate 23, at least to the extent that when the locking plate 23 is attached to the shank member 11 that the post receiving means 21 will be prevented from sliding off of the post member 17.

Consequently, it is believed to be clear that the present invention accomplishes the objects referred to above. Obviously many modifications and variations of the present invention are possible in light of the above teachings. It is therefore to be understood that, within the scope of the appended claims, the invention may be practiced otherwise than as specifically described.

I claim:

1. An interchangeable mouthpiece bit for use with horses or the like comprising:

a pair of spaced apart shank members adapted at one end thereof for connection to a means for attachment to one portion of a horse's head and adapted at the other end thereof for connection to reins;

mouthpiece means attached to an intermediate portion of each of said shank members for insertion into the mouth of a horse; and connection means for selectively detaching and reattaching said mouthpiece to said shank members whereby one pair of shank members can be used with a plurality of different mouthpiece means, said connection means comprising:

a post means rigidly attached at one end thereof to one of an intermediate portion of each of said shank members and said mouthpiece means;

post receiving means connected to the other of said intermediate portion of each of said shank members and said mouthpiece means for being slideable onto said post means and extending around said post means far enough to allow only said slideable movement between said post means and said post receiving means when said post receiving means is disposed on said post means; and locking means attached to one of an intermediate portion of said shank members and said mouthpiece means for selectively preventing said slideable movement between said post means and said post receiving means.

2. The interchangeable mouthpiece bit of claim 1 wherein said post means is disposed on each of the intermediate portions of said shank members and said post receiving means is disposed on each end of said mouthpiece means.

3. The interchangeable mouthpiece bit of claim 1 wherein said post receiving means completely encircles said post means.

4. The interchangeable mouthpiece bit of claim 2 wherein said locking means comprises:

a locking member having an opening therein, a portion of said post receiving means being disposed in said opening when said locking means is locked; and attachment means connected to said locking member and to an intermediate portion of said shank members for selectively attaching said locking member to said shank member.

5. The interchangeable mouthpiece bit of claim 4 wherein said locking member has a decorative outer cover attached thereto covering said opening.

6. The interchangeable mouthpiece bit of claim 4 wherein each of said locking members have a first and second hole disposed therein, one of said holes in each locking member being threaded, each of said shank members having a protuberance rigidly attached thereto for being received into the other of said holes in said members, a hole disposed in each of said shank members and bolt means for passing through said holes in the shank members and for threadably engaging the threads of said one threaded hole in each of said locking members whereby said locking members are securely held to said shank members.

7. An interchangeable mouthpiece bit for use with horses or the like comprising:

a pair of spaced apart shank members adapted at one end thereof for connection to a means for attachment to one portion of a horse's head and adapted at the other end thereof for connection to reins;

mouthpiece means attached to an intermediate portion of each of said shank members for insertion into the mouth of a horse; and connection means for selectively detaching and reattaching said mouthpiece to said shank members whereby one pair of shank members can be used with a plurality of different mouthpiece means, said connection means comprising:

a post means attached at one end thereof to each of an intermediate portion of each of said shank members;

post receiving means connected to each end of said mouthpiece means for being slideable onto said post means and extending around said post means for enough to allow only said slideable movement between said post means and said post receiving means when said post receiving means is disposed on said post means; and locking means attached to one of an intermediate portion of said shank members and said mouthpiece means for selectively preventing said slideable movement between said post means and said post receiving means, said locking means comprising:

a locking member having an opening therein, a portion of said post receiving means being disposed in said opening when said locking means is locked; and attachment means connected to said locking member and to an intermediate portion of said shank members for selectively attaching said locking member to said shank member.

8. The interchangeable mouthpiece bit of claim 7 wherein said locking member has a decorative outer cover attached thereto covering said opening.

9. The interchangeable mouthpiece bit of claim 7 wherein each of said locking members have a first and second hole disposed therein, one of said holes in each locking member being threaded, each of said shank members having a protuberance rigidly attached thereto for being received into the other of said holes in said members, a hole disposed in each of said shank members and bolt means for passing through said holes in the shank members and for threadably engaging the threads of said one threaded hole in each of said locking members whereby said locking members are securely held to said shank members.

* * * * *